US009058726B2

(12) United States Patent
DeLise

(10) Patent No.: US 9,058,726 B2
(45) Date of Patent: Jun. 16, 2015

(54) APPARATUS AND METHOD FOR GAMING

(71) Applicant: Anthony J. DeLise, Sparks, NV (US)

(72) Inventor: Anthony J. DeLise, Sparks, NV (US)

( * ) Notice: Subject to any disclaimer, the term of this patent is extended or adjusted under 35 U.S.C. 154(b) by 216 days.

(21) Appl. No.: 13/624,728

(22) Filed: Sep. 21, 2012

(65) Prior Publication Data

US 2014/0087813 A1 Mar. 27, 2014

(51) Int. Cl.
*G07F 17/32* (2006.01)

(52) U.S. Cl.
CPC ..... *G07F 17/329* (2013.01)

(58) Field of Classification Search
USPC ..... 463/17, 12, 13
See application file for complete search history.

(56) References Cited

U.S. PATENT DOCUMENTS

2008/0161099 A1* 7/2008 Sines et al. ..... 463/20
2009/0291742 A1* 11/2009 Sines et al. ..... 463/20
2012/0238338 A1* 9/2012 Kuhn et al. ..... 463/11
2013/0344937 A1* 12/2013 Kuhn et al. ..... 463/20
2014/0323205 A1* 10/2014 Roemer ..... 463/25

* cited by examiner

*Primary Examiner* — Pierre E Elisca
(74) *Attorney, Agent, or Firm* — Long & Chybik; John D. Long, Esq.

(57) ABSTRACT

One possible embodiment of the invention could be a method of playing a game comprised of the following steps selecting from the set of gaming symbols one or more winning gaming symbols for the play of the game; providing at least one playing card, the playing card presenting one or more gaming symbols for the play of the game, the card displaying the one or more winning gaming symbols; publishing one or more winning gaming symbols prior to a distribution of at least one playing card, distributing at least one playing card to at least one gaming participant; and comparing the gaming symbols of the distributed playing card with the one or more winning gaming symbols to determine if the distributed playing card has any gaming symbols that match the one or more winning gaming symbols to establish the distributed playing card as a winning play card.

19 Claims, 8 Drawing Sheets

APPARATUS AND METHOD FOR GAMING

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to gaming. More specifically, the present invention may be related to lottery-style gaming.

BACKGROUND

Many lottery-style gaming systems may provide a set of playing cards or tickets that could be distributed to participating players who pay for one or more such playing cards to participate in the system. These playing cards may present one or more playing symbols or sets of playing symbols that are compared against winning gaming symbols to determine if a participating player's playing ticket(s) is a winning playing ticket(s) for the game. In many such instances, once the playing tickets have been created/provided and subsequently distributed, the respective lottery game system then selects, randomly or otherwise, one or more playing symbols to be the selected winning playing symbols. After the selection, the system generally then publishes the selected winning playing symbols to the participating players. This publication allows the participating players to compare the playing symbols displayed on their playing ticket (s) to selected winning playing symbols to determine if there is a matchup or at least a partial matchup with the published, selected winning playing symbols. If the participating player has a playing card whose playing symbol(s) matches one or more selected winning playing symbols that playing card, depending upon operator's rules, could be considered a winning playing card with a prize being awarded to the participating player, the value of the prize awarded being increased based on the increased completeness of the matchup.

Another possible version of such lottery style systems could be those lottery games that utilize laminated playing cards with cutout tabs on their top side that generally reversibly covers and seals one or more of the card's playing symbols (e.g., that are generally randomly generated by the system) located upon one of the internal surface of the card's laminates. On such a playing card (e.g., its backside) could generally be found gaming indicia identifying one or more selected winning symbol combinations (e.g., such as standard winning poker game symbol combinations). Generally, these are established winning symbol combinations do not change from game to game (each time the game is played). After the playing card is then sold/distributed, the participating player then pulls open on the pull tab(s) to expose the set of randomly generated playing symbols for that particular playing card. The participating player could then compare the playing card's set of revealed playing symbols with the gaming indicia on the card's backside to determine if the ticket's set of playing symbols matches up with the selected winning combination of playing symbols to establish if the participating player has a winning playing card.

In yet another version such systems, such a Keno, a player of the game may select playing symbols (or has a computer randomly select playing symbols) that are to be printed on a playing ticket or otherwise documented for the play of that particular game. Usually, at a time after the sales of the playing tickets for that game is concluded, the game operator then causes a (generally random) generation of a selected winning combination of symbols which are then subsequently published. The participating players then compare their selected playing symbols (e.g., the ones printed on the Keno tickets/receipts) with the published, selected winning combination(s) of playing symbols to see if there is any matchup that could result in the participating player possessing a winning playing card for that game.

In such lottery game systems, wherein the selection of the winning combination(s) of playing symbols generally is established after the sale/distribution of playing cards/tickets or may be established before sale/distribution of the playing tickets only to use the same selected winning playing symbol combination from game-to-game. In this manner, there could be seen a possible stagnation in actual gaming excitement and failure to realize the full potential of possible gaming excitement/publication/publicity that could be delivered by such systems wherein only the post card distribution time period is used to publicize the game and missing an opportunity for increasing game promotion and overall game awareness by not selecting/publishing the selected winning symbol combinations (that are selected anew each play of the game) before the game play (e.g., before the participation of the player in the game). Further, there can be seen lowered level of interest occurring due continued use of the same selected winning symbol combinations between the games rather than creating new excitement that could come about by changing the selected winning symbol combinations from game to game.

What is needed therefore is a lottery-style game having a playing card/system and method of operation wherein a winning combination(s) of gaming symbols used in determining winning playing cards for the game is generally selected anew for each play of the game. The selection and subsequent publication of same could substantially be prior to the commencement of actual play of the game (e.g., the participation of the players in the game). By engaging is such pre-play activities (as well following them up in post-play time period), the invention can build up the publicity and excitement for the game at a much earlier stage and be continued for a longer period that is normally done for those games that only use post-play time period publicity. This significant increase in pre-play publicity could further allow for additional seeding in the public's mind to get excited about the play of the game, much in a way a fisherman could chum the waters before fishing to attract more fish to the fishing site.

The invention could be played by itself or it could be used as a supplemental game used in conjunction with a primary game that generally uses a playing card (e.g., Bingo, Keno, Lottery, etc). As a supplemental game, its play could be conducted separate and distinct from the play of the primary game although the actual playing of the primary game and supplemental game could overlap. In both situations, the supplemental game could be used as an enhancement for the primary game by increasing the player's excitement for the primary game; providing a supplemental revenue stream to that of the primary game; increasing the revenue stream of the primary game; and promoting the primary game by attracting attention of the gaming public during the pre-play time period that is otherwise normally underutilized for the primary game for such purposes.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to substantially utilize one or more the playing symbols of a primary game displayed on a playing card as gaming symbols for a supplemental game played using the same playing card;

provide, with relative ease and contained cost, generally a supplemental game that enhances a primary game, the supplemental game further providing a revenue stream in addition to the revenue stream of the primary game;

the ability to substantially demarcate one or more playing symbols of a primary game as gaming symbols for use in a supplemental game, the supplemental game generally being played distinct and apart from the primary game, with both games being substantially played on the same playing card;

provide substantially a reversibly sealed playing card for use with a primary game and supplemental game, the card generally covers one or more primary game playing symbols that are further demarcated for use as gaming symbols of a supplemental game;

the ability to substantially create additional game publicity and player excitement during the pre-play period for a primary game that normally selects it's winning symbols after distributing of its playing cards;

the ability to generally create an additional revenue stream during the pre-play period for a primary game that normally selects it's winning symbols after distributing of its playing cards;

provide a lottery-style game that substantially selects and publishes it winning gaming symbols prior to the commencement of game play, wherein the selected winning gaming symbols are generally picked anew for each game play; and provide a supplemental game may be played contemporaneously with a primary game utilizing the same playing card as the primary game, the supplementary game selecting its winning symbols at a different time from the primary game, the supplement game further acting to enhance the player excitement for the primary game as well as providing a supplemental revenue for the primary game operator with little additional cost and effort.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a method of generally playing a game comprised of the following steps of selecting from a set of gaming symbols, one or more winning gaming symbols for the play of the game, generally selecting of one or more winning gaming symbols occurs prior to providing at least one playing card; and the selecting of one or more winning gaming symbols is preformed anew for each game; generally providing at least one playing card presenting one or more gaming symbols for the play of the game; generally distributing at least one playing card; and generally comparing the gaming symbols of the distributed playing card with the selected one or more winning gaming symbols to determine if the playing card is a winning game card.

Another possible embodiment of the invention could be a playing card for playing a primary game and a supplemental game, the primary game being played separate and apart from the play of the secondary game, comprising of a playing card presenting a set of playing symbols used in the play of the primary game; a demarcation means for identifying one or more playing symbols from the set of playing symbols as gaming symbols for use in the supplemental game; and a coverage means for reversibly obscuring one or more gaming symbols on the playing card.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
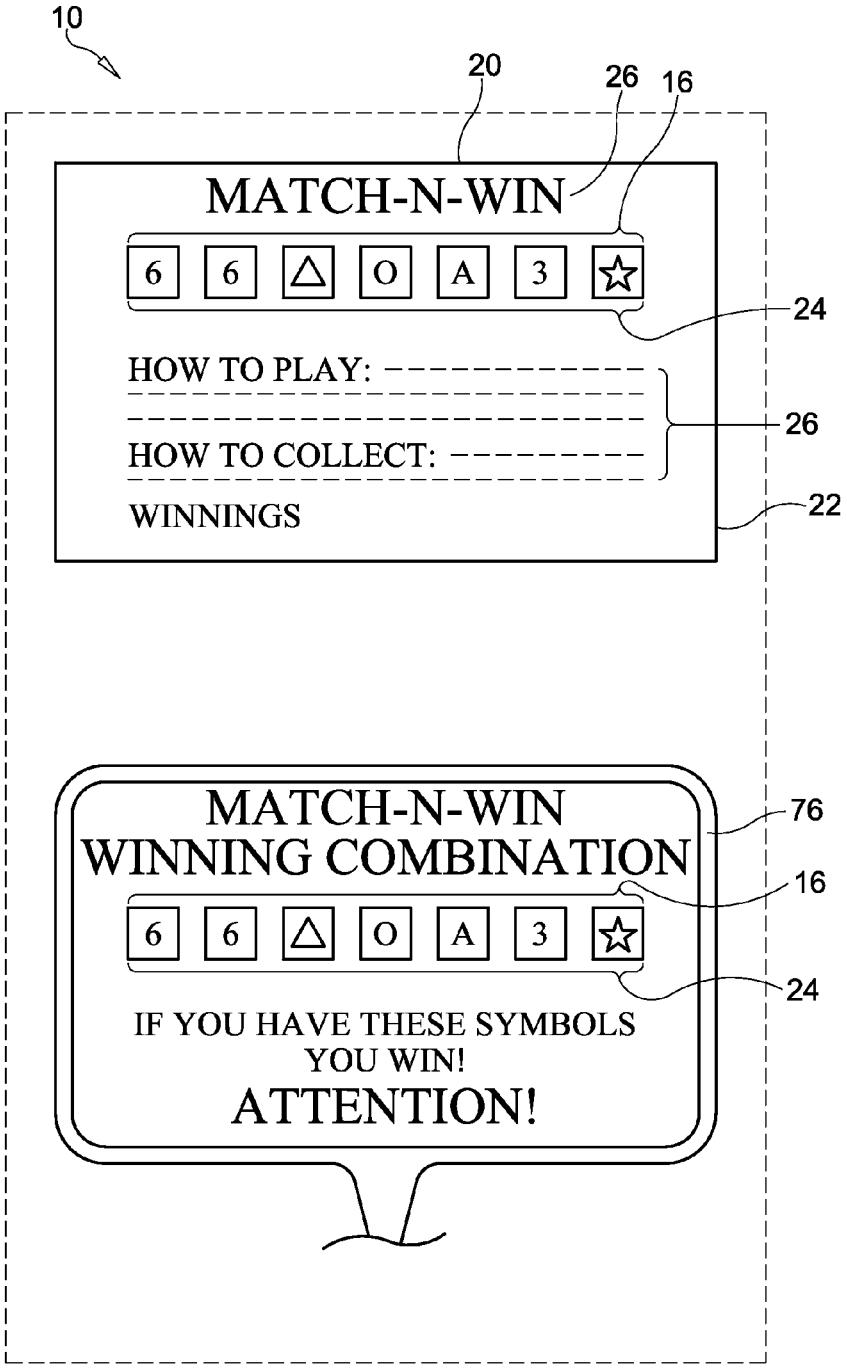
FIG. 1 is substantially a view of paper format of the playing card or ticket as used in one embodiment of the present invention, wherein the invention is played on its own.
Figure 4:
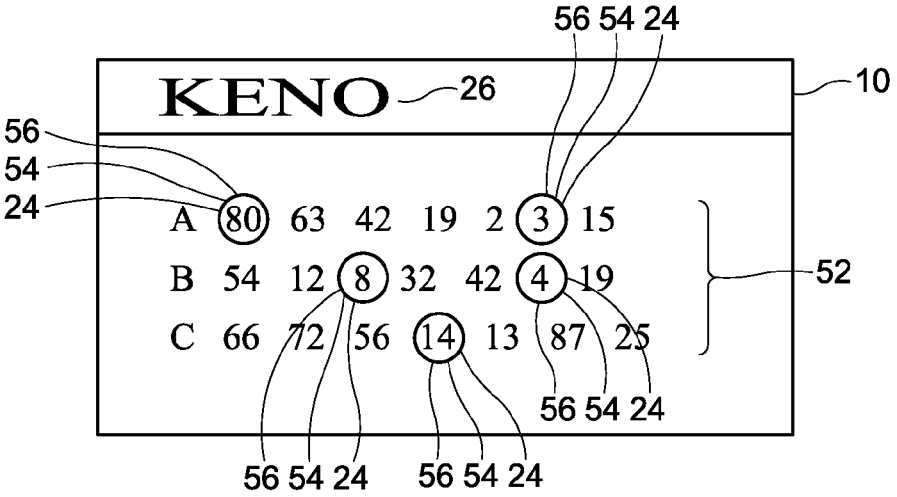
FIG. 4 is substantially a view of a playing card as used in one embodiment of the present invention, wherein the invention is played with a primary game of Keno.
Figure 4A:
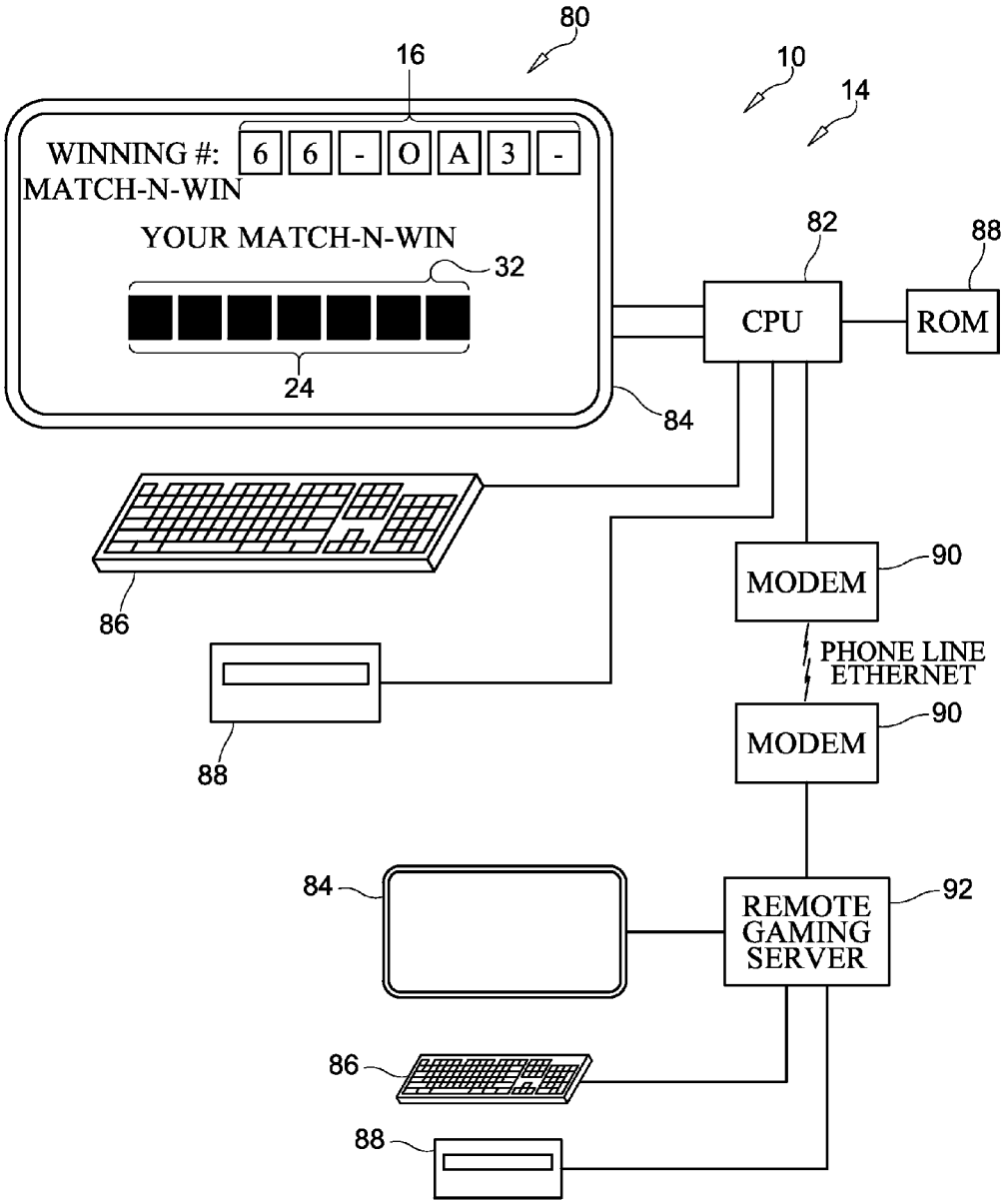
FIG. 4A is substantially a view of an electronic format of the playing card or ticket as used in one embodiment of the present invention.
Figure 5:
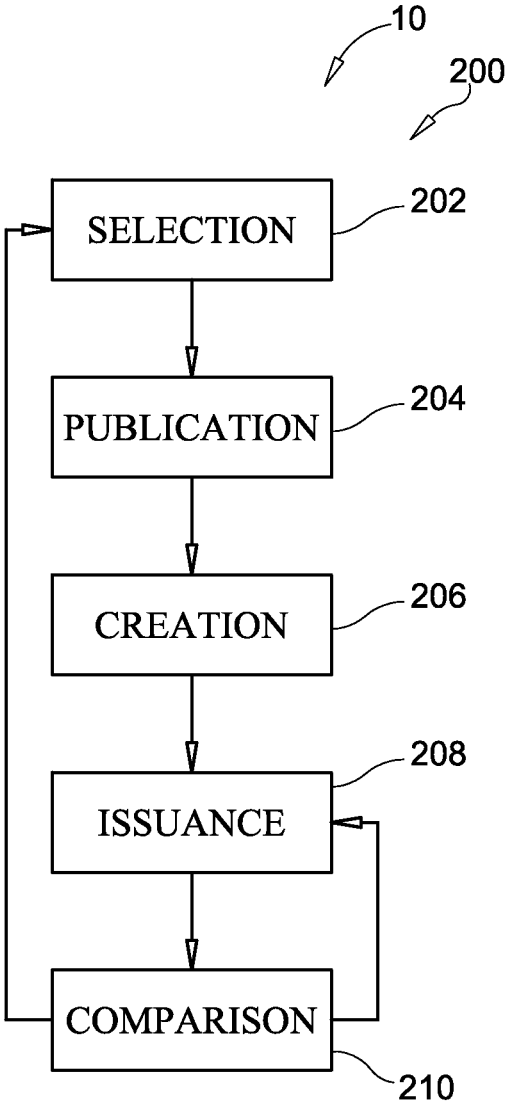
FIG. 5 is substantial a flow chart showing one possible embodiment for the method of the game.

As substantially shown in FIGS. 1, 4A, and 5, the invention 10 could generally be seen as being a lottery-style gaming system 14 using a playing card/ticket (in a paper, electronic or other suitable format) 20 used with a method or process of operation 200 utilizing a set of gaming symbols 24. From the set of gaming symbols 24 is substantially selected (e.g., randomly) one or more winning gaming symbols 16 with its subsequent publication to the public (e.g., potential participating players of the system 14). The selection could be done anew for each play of the invention 14 (e.g., the game) with the general result that each game would have a different combination or set of winning game symbol(s) 16. The publication substantially occurs both before the steps of providing (e.g., creation) of the playing cards 20 and the distributing of the playing cards 20 to participating players (not shown) to the invention 11. The playing cards 20 are then generally provided (e.g., created), with each playing card 20 providing a presentment of one or more gaming symbols 24. The play cards 20 are then generally distributed to participating players who compare the presented gaming symbols 24 of their respective playing cards with the selected winning gaming symbols 16 of the game to determine if their playing card(s) 20 may be a winning playing card(s) 22. Prizes for the winning play of the invention 10 can be awarded in increasing value to the holder of a winning playing card 22 based on the increased completeness of matchup between card's presented gaming symbols 24 and the selected winning gaming symbols 16 for that game play.

In this manner, the invention 10, during pre-game play (e.g., such as the selection/publication steps that generally occur before prior to the creation and distribution of playing cards to the players), has the selection/publication of the winning gaming symbols 16. The publishing of the selected winning gaming symbols 16 to the public during this pre-play time period (and subsequent post-play time period) can allow the invention 10 to substantially foster greater game play awareness and excitement to the public over traditional lottery style games who select/publish winning gaming symbols 16 only after player participation occurs (e.g., only during post-play time period). The invention 10 by increasing the time period (e.g., the time both prior to and after playing card creation and distribution vs. just the time period after playing card distribution for most lottery-type game) during which it can publicize the selection of winning gaming symbols 16 and promote invention game play, the invention 10 can fostering greater player game anticipation and excitement in the present invention 10 with resultant greater player participation in the invention 10 and potentially corresponding increase in gaming revenues for the invention's operator.

The format of the playing card 20 and corresponding process or method of operation 200 can have the invention 10 be played by itself or played as an enhancement or supplemental game 30 to another or primary game 50 of chance. In one version, wherein the invention 10 is used as a supplemental game 30, the invention 10 could utilize one or more the playing symbols 52 as used by the primary game 50 (and shown on a playing card 20) that are generally demarcated for additional use in the supplemental game 30. The game play of the primary game 50 and supplemental game 30 could be kept separate and distinct from one another although the game play of the primary 50 and supplemental game 30 could be contemporaneous.

The format of the playing card 20 can range from traditional paper playing card type (e.g., a bingo card, Keno card, etc.) to that of the electronic image/representation of a playing card 20 and/or gaming indicia 26 generally found on the playing card/ticket 20. The electronic image/representation of the playing card 20 and the like being transmitted to a participating player (not shown) through a wide variety of electronic means 80 (e.g., stand-alone computer, server-based gaming technology, internet/web portal-based gaming, and the like) that is capable of processing utilizing suitable software of the play of the invention 10.

In one possible embodiment of invention 20 wherein the invention 10 is substantially played by itself, the invention 10 could feature a playing card or ticket 20 (in a paper, electronic or other suitable format) and a publication means 76. The playing card 20 could generally have overall layout/format substantially similar to that of a standard lottery ticket 12. The playing card 20 could have various gaming indicia 26, such as gaming symbols 24 displayed for the playing card 20, game title, rules for play of the game, operator contact information and the like.

The publishing means 76 (as substantially shown in FIG. 3A) could be as signage, audible transmission means, or other suitable instrumentality of communication separate from the playing card 20 or it could be a space on the playing card 20 presenting selected winning combination of gaming symbols 16 to communicate the winning game symbols 16 to public.

In one paper version of such an embodiment, the playing card 20 could be issued by computer terminal/printers (not shown) much like those used in standard government lottery games. The playing cards 20, as they are loaded into such machine, could have blank spaces specifically designated to receive the printing of gaming symbols upon the playing card 20 by the terminal. In this manner the playing card 20 (after the selection and publication of winning combination of gaming symbol(s) 16) could be fully and instantly provided/created (and distributed) as the gaming symbols 22 for the respective playing card 20 may be generally randomly generated by the terminal. This instant random selection of gaming symbols 24 for the playing card 20 generally provides security against the risk of a knowing, non-random selection or creation of winning gaming card/ticket 22 by a player or others.

In another possible embodiment of the invention 20, wherein the playing cards 20 (e.g., a paper, electronic, or other format), the invention 10 could be so formed or presented to participating player to have the respective gaming symbols 24 reversibly blocked or otherwise obscured by a wide variety of coverage means 32 prior to the distribution or issuance of the playing cards 20 to the participating player. This embodiment, at least for paper-based playing cards 20 that are batch-created/printed prior to the publication of the selection of the winning gaming symbols 16 as well as electronic-based playing card 20 displayed on screens of the visual interface 84 prior to the publication of the winning gaming symbol combination(s), may also be used as a security means of preventing the non-random, knowing selection of a winning playing card 22 by the player or others based on the later publicly-disseminated knowledge of the selected winning gaming symbols 16. The gaming symbols coverage means 32 could range from pull-tab laminates, folded sheets, scratch off covers for paper formats to blanked-out gaming symbol spaces on visual presentations provided by the electronic presentations of the playing cards 20.

Figure 2:
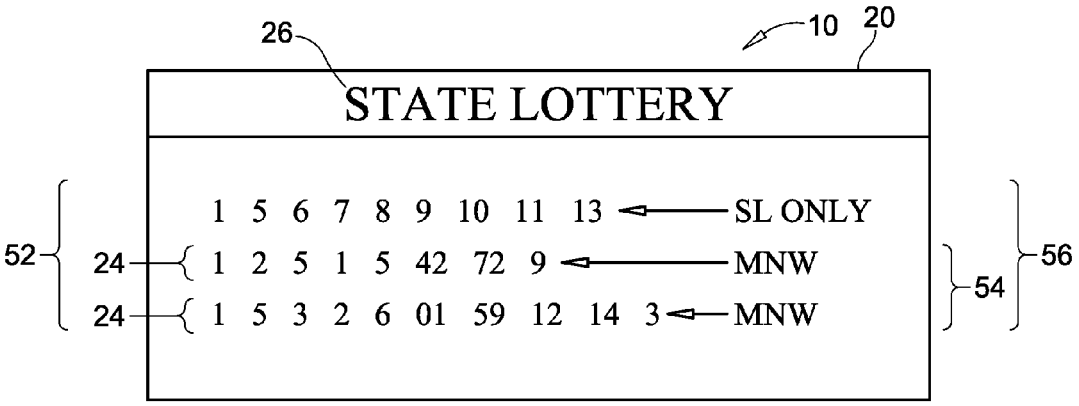
FIGS. 2, 2A, and 2B are substantially views of a playing card as used in one embodiment of the present invention, wherein the invention is played with a supplemental game, a lottery game.

As substantially shown in FIG. 2, a substantial benefit could be obtained in another embodiment of the invention 10 whereby present invention 10 presents its own game as a supplement game 30 for another different primary game of chance 50 that also uses a playing card 20. The primary game 50, as such, could include such games as Bingo, Keno, Pull-tab lottery, quick pick lottery. The primary game 50 could also be another type of games, such as an electronic slot games (not shown) such as those for electronic poker games. In this manner, the invention 10 could provide supplemental game 30 whose action could complement the play of the primary game 50 wherein the participating player by selecting to play the primary game 50 could automatically get to participate in a supplemental game 30 (the game or method 200 of the invention 10). In this manner, the supplemental game 30 can be seen as a complementary, yet separate enhancement for the primary game 50 to attract new interest in, new excitement about, and new additional revenue for the primary game 50.

In at least one version of this embodiment, the primary game 50 could be a standard lottery-type game (e.g., Lotto) wherein its playing card 20 could be further adapted to provide space for the gaming symbols 24 of the supplemental game 30. For example, if a player wants to play the primary or lottery game 50 (e.g., utilizing a quick pick/instant pick or personally-selected lottery numbers), the player can also decide if they want to be a participating player and play the supplemental game 30 as well. If player decides to play the supplemental game 30, the lottery ticket computer terminal could instantly randomly pick the gaming symbols 24 for the supplemental game 30 and print those gaming symbols 24 onto an area of that particular playing card 20 allotted for those gaming symbols 20. The playing card 20 (with or without the standard lottery playing symbols 52) is then issued to the participating player who can then compare the gaming symbols 24 with the previously-selected winning gaming symbols 16 to determine if the playing card 20 is a winning ticket for the invention 10.

Figure 2A:
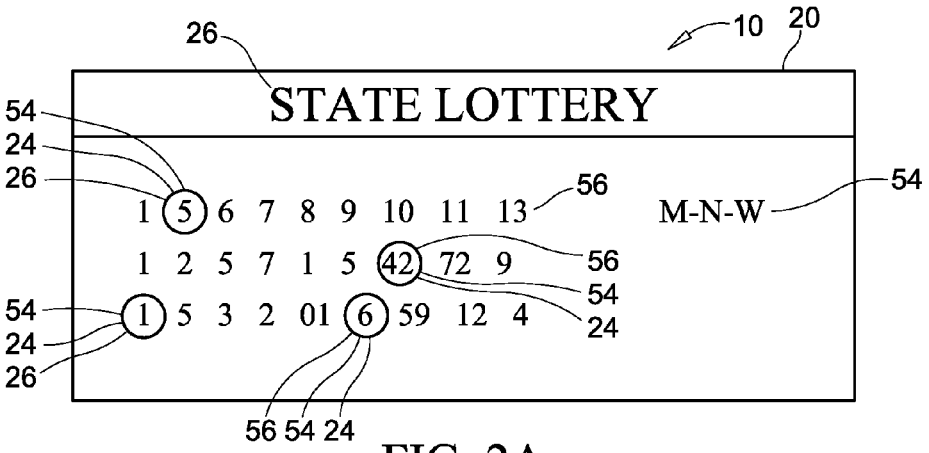

As substantially shown in FIG. 2A, another version of this primary game 50 supplementary game 30 combination in which one or more of the playing symbols 52 for the primary game 50 printed on the playing card 20 are identified by a demarcating means 54 to denote those playing symbols 52 are to be also be used as gaming symbols 24 for use in the supplemental game 30 (e.g., the lottery ticket computer terminal could be programmed to simultaneously and randomly designate or otherwise demarcate one or more of the standard lottery playing symbols 52 to also act as gaming symbols 24 for the supplemental game 30.) This selection of various playing symbols 52 could be done through a variety of demarcation means 54 (e.g., having the demarcated playing symbols utilize italics; bolding; changing font, size, coloration, etc. and the like that are different from the non-demarcated playing symbols 52). Upon issuance of the playing card 20, the participating player could check the demarcated playing symbols 52 against the previously publishing selected winning gaming symbols 16 for the supplemental game 50 to see if the playing card 20 was a winning playing card 20 for the supplemental game 30. The participating player could also check all of the standard lottery playing symbols 52 (demarcated or not) of the playing card 20 for any matchup with any of the later-selected lottery winning playing symbols 52 to see if the playing card 20 is a winning playing card 20 for the primary game 50 (i.e., standard lottery-type game).

Figure 2B:
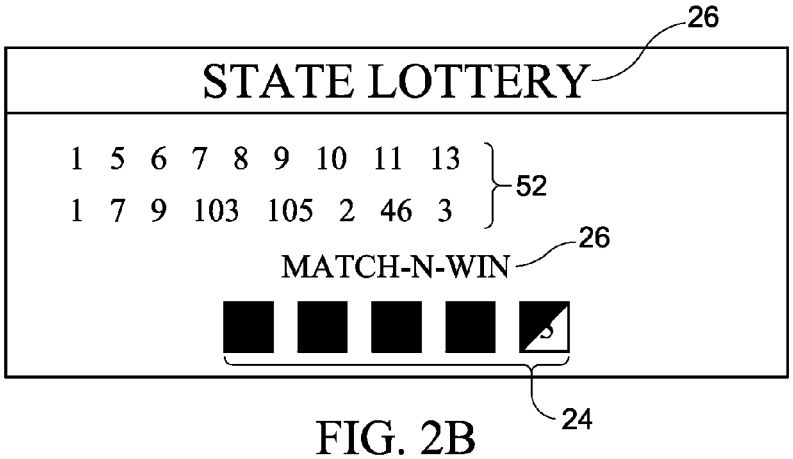

In another version of this embodiment (as substantially shown in FIG. 2B), the primary game 50 could be sold with the supplemental game 30, wherein a participating player in buying the playing card 20 for the primary game 50 (e.g., standard lottery game) automatically gets a chance to play the supplemental game 30. This embodiment of the invention 10 could dispense with the terminal printed "quick pick/instant" random selection of the gaming symbols 24 for the supplemental game 30 and could instead have the playing card 20 being constructed with reversibly-obscured game gaming symbols 24 (e.g., employing a coverage means 32 such as a scratch covering, a pull-tab laminate covering, or other suitable apparatus reversibly obscuring the supplemental game's gaming symbols 24).

An appropriate blank space on the playing card 20 could be designated for the printing of the standard lottery playing symbols 52 by the lottery ticket computer terminal. Once a set of playing cards 20 are so created, they could then be loaded into a lottery terminal printer (not shown). The player in deciding to play the primary game 50 could be automatically rewarded with playing the supplemental game 30. The participating player could personally choose or use random selection to pick the primary game's 50 playing symbols 52. The playing card 20 could then have those player selected lottery-type game playing symbols 52 printed upon it and then be subsequently issued to the participating player or like. The participating player could then uncover or otherwise reveal the gaming symbols 24 of the supplemental game 30 (and check them for a win against the previously published/select combination of winning gaming symbol[s] 16) while waiting for the winning lottery-type game playing symbols 52 to be picked.

Figure 3:
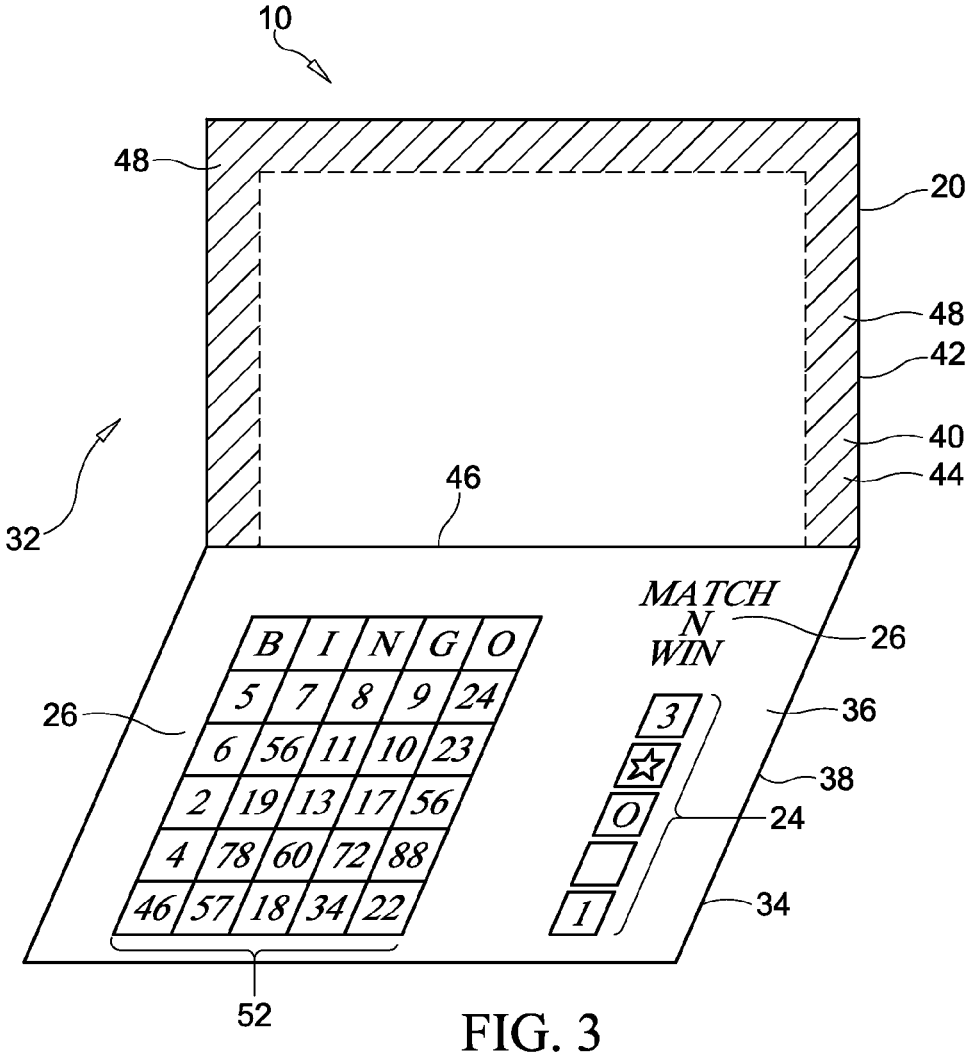
FIGS. 3 and 3A are substantially views of a playing card as used in one embodiment of the present invention, wherein the invention is played with a primary game of Bingo.
Figure 3A:
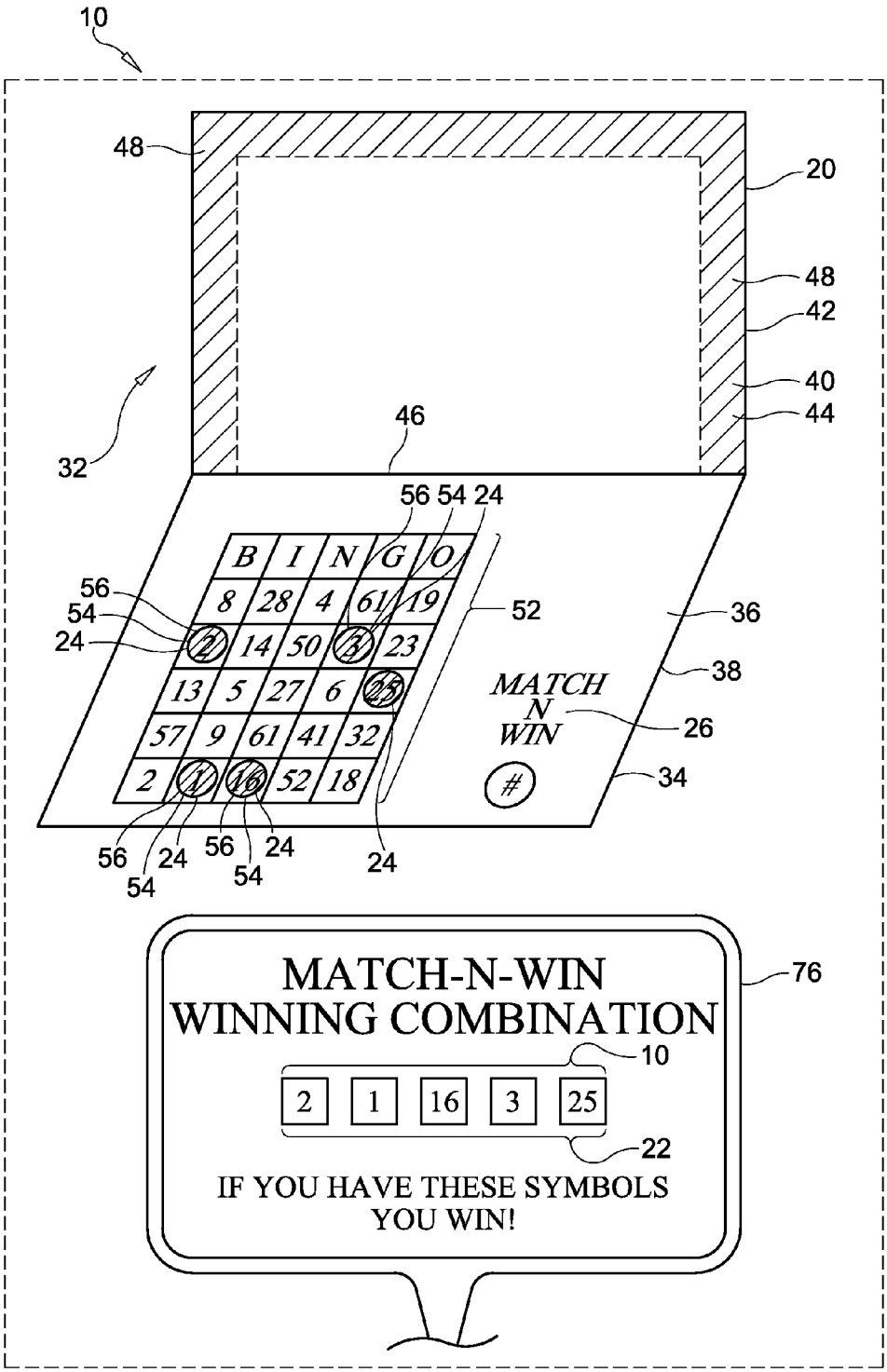

As shown substantially in FIGS. 3, 3A, another embodiment the invention 10 could have as its primary game 50, the game of Bingo. In this version, the playing card 20 could be constructed to present at least a Bingo playing format (e.g., Bingo grid and the like) for the play of the Bingo game, as the primary game 50, the format being further constructed to present gaming symbol[s] 24 for the supplemental game 30 separate and distinct from the playing symbols 52 used for the primary game 50 (e.g., Bingo.) Such a playing card 20 could also provide a multitude of such Bingo playing formats and still be considered within the scope of the invention 10. In at least one version, these gaming symbols 24 could accorded their own area of the playing card 20 generally separate apart from the area used to present the Bingo playing symbols. In another embodiment, these gaming symbols 24 could also be incorporated within the Bingo format by utilizing demarcated Bingo playing symbols 52.

The playing card 20 could be further constructed to implement incorporate a coverage means 32 that generally obscures gaming symbols 24 and/or playing symbols 52. One example of this coverage means 32 for a paper format playing card 20 for Bingo could generally comprising a first section 34 and a second section 40, the first section 34 generally having two sides, a top side 36 and a bottom side 38 while the second section 40 could two sides as well, a first side 42 and a second side 44. The second section 40 could be foldably attached to an edge 46 of the first section 34 and to fold over to substantially have its second side 44 reversibly cover and seal (e.g., or shield and the like) the top side 36 of the first section 34 to substantially cover any gaming symbols 24 as well as any playing symbols 52 shown on the top side 36. The second section 40 could be further held in place over the first section 34 by a variety of attachment means 48 such an applying adhesive or tape to the contacting, non-folding edges of the sections and the like.

The top side 36 of the first section 34 (or the top side 36 and second side 40, once unfolded, together) could have a standard Bingo grid 60 of columns and rows wherein the header spaces at the top of columns of the grid could be appropriately topped by the letters spelling B-I-N-G-O while the other spaces contain Bingo playing symbols 52. In this manner, the Bingo playing symbols 52 of the primary game 50 can be selected and demarcated to double as gaming symbols 24 for supplemental game 30 (of the invention 10). Such demarcation means 54 could be any such apparatus which allows the BINGO playing symbols 52 selected for use as gaming symbols 24 for supplemental game play to be identified or otherwise distinguished from the Bingo playing symbols not so selected. Such demarcation means 54 could including: having a background of the space of a Bingo playing symbol 52 that is selected to be a gaming symbol 24 which is different in shading, font, type, color, background, size, or the like from the space of non-selected Bingo playing symbol 52 and the like. In this manner, the combination playing symbols 52/gaming symbols 24 can still be available for daubing or marking for regular Bingo game play.

Figure 4B:
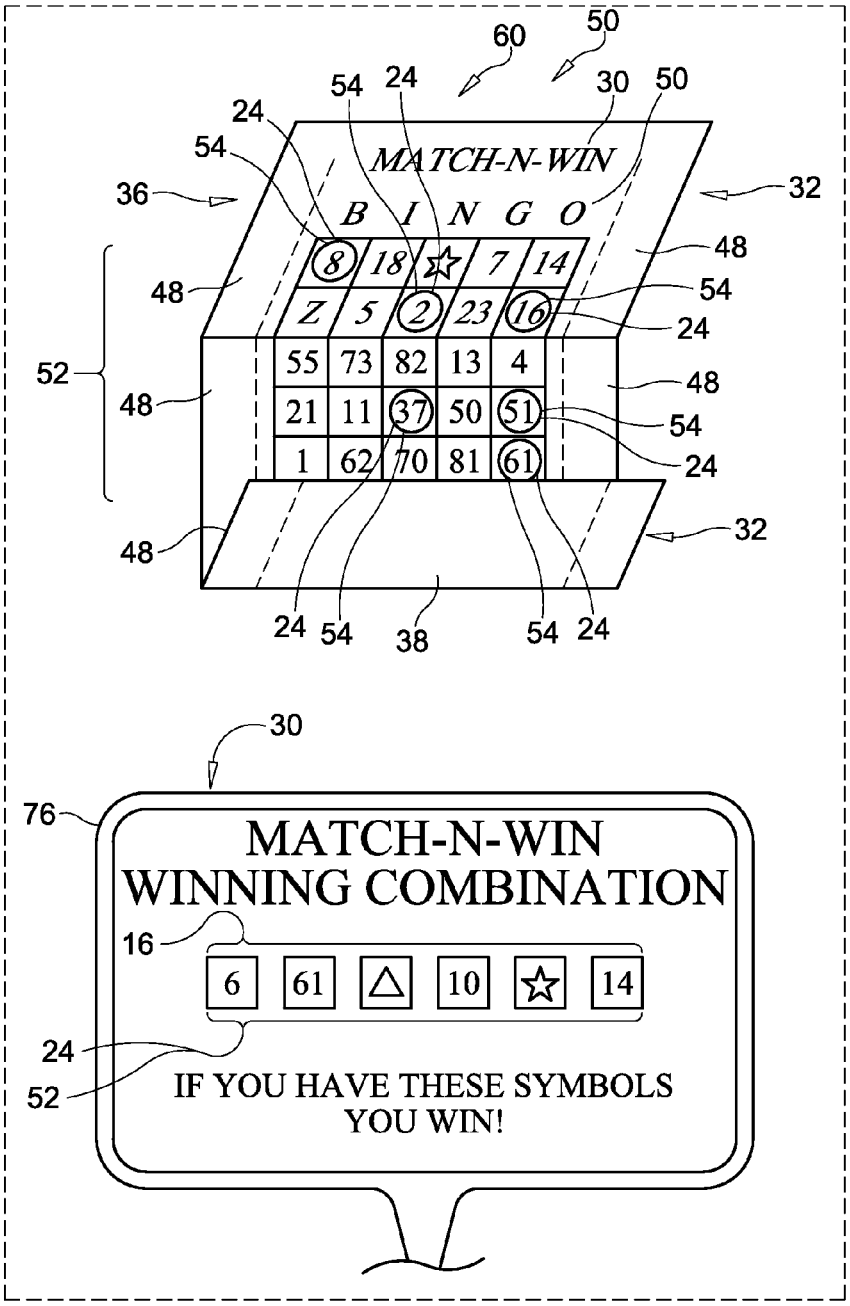
FIG. 4B is substantially a view of another version of the playing card as used in one embodiment of the present invention, wherein the invention is played with a primary game of Bingo.

As substantially shown in FIG. 4B, another version of the Bingo embodiment could utilize a coverage means 32 whereby the playing card 20 comprises of a first section 34 wherein the first section 34 folds in upon itself so that only the bottom side 38 is visible as an outside cover while the top side 36, displaying the game indicia 26 for the primary and supplemental games 50, 30 is suitably covered and obscured. In such a version, adhesive upon the edges of the playing card 20 can hold the playing card 20 in its folded configuration while perforated lines proximate to one or more of the edges 46 can be utilize to release the playing card 20, when torn, from its folded configuration and into its playing configuration.

Another version of this embodiment could also utilize a set of gaming symbols 24 that are selected and demarcated from the Bingo playing symbols 52 of the playing card 20 (in electronic format, paper format, and other format). This version could also employ coverage means 32 of reversibly occluding the gaming symbols on the playing card 20.

As substantially shown in FIG. 4, another embodiment of the invention could have Keno as a primary game 50 used with the supplemental game 30. In this manner, through paper or electronic format, the player could place with a Keno operator, a player-selected or terminal randomly/instantly picked Keno symbols. For optional playing of the supplemental game 30, the Keno receipt or playing card 20 could be created with a space for the gaming symbols 24 to be printed on. If the player decides to play the supplemental game 30, the operator can direct the Keno gaming computer terminal/printer to randomly pick the gaming symbols 24 for the supplemental game 30. The Keno printer would then create/distribute a playing card 20 (e.g. Keno ticket or receipt) for use by the participating player. The playing card 20 could have separate areas for both the player's selected Keno playing symbols 52 as well as the randomly-picked gaming symbols 24 for the supplemental game 30.

In one or more versions of the Keno embodiment of the invention using random instant pick for the selection of the Keno, the playing symbols 52 of the Keno game could be demarcated as the gaming symbols 24 for supplemental game 30. In such operations, the playing card 20 would need to be marked to show that both games were being played with the playing symbols 52 selected to be gaming symbols 24. In such an embodiment, the playing symbols of Keno game could be organized into sets, with the machine randomly picking and demarcating one or more such sets as a set of gaming symbols 24 for use in the supplemental game 30. In another version of such an embodiment, individual playing symbols 52 could be individually demarcated for use as gaming numbers 24 for the supplemental game 30.

As substantially shown in FIG. 4A, an electronic version of the invention 10 can be implemented in a wide variety of ways known to those who have ordinary skilled in the art and can easily accommodate the various forms of the invention 10 as described within. A representation of the electronic means 80 for providing a presentation of the playing card/ticket 20 as set forth below is meant only to be illuminative, not limiting, of the myriad of ways that this electronic version can be implemented yet still be considered part of the invention 10. Such an electronic means 80 could comprise of a CPU 82 coupled (e.g., wired, wireless) to a visual interface (e.g., display screen) 84, a user interface 86 (e.g., keyboard, although touch technology could allow the visual interface 84 to act as the user interface as well), and suitable gaming computer peripherals 84 (e.g., printer, card reader, change maker, etc) as needed to operate the method 200 of the invention 10. The CPU 82 could have suitable computer processing componentry (e.g., RAM, ROM, etc) as required to run the suitable gaming software used to create the imagery of the playing card/ticket 20 at the visual display and process/store the gaming data, running of the game, and alike as related to the invention 10. The CPU 82 could be operate as a standalone device capable of operating software for the invention 10, running software for the invention 10 and processing gaming data and alike used for the running of the invention 10. In another version, the invention 10 could be connected by a remote connection means (e.g., modem or alike) 90 to a remote server 92 (e.g., by direct communications link [dedicated phone line] or by indirect access through the world wide web or the like for login to a web portal). The direct communications link could connect the CPU 82 to a dedicated remote server 92 that could generally handle the running of the software for the invention 10 and for processing/storing the gaming data for the invention 10. The use of such a remote server 92 generally would relegating the CPU 82 to transmitting, receiving and presenting the data between the remote server 92 and a participating player (not shown) utilizing the CPU 82.

In another version, the modem or alike remote connection means 90 could be used to connect the CPU 82 through the worldwideweb (or like) to login onto an internet portal/website to access a remote website server 92 that would generally handle the processing/storing of the data for the play of the invention and running of the software for the invention to reduce the use of the CPU 82 and its peripherals to being merely being the overall player interface with the remote website server 92.

In this manner, the gaming software and data processing/storage of gaming information utilized by the electronic means 80 for the electronic processing, operation, and presentation of the invention 10 could allow the visual interface 84 to set forth an electronic visual presentation of the gaming indicia (e.g., playing symbols, gaming symbols, winning gaming symbols, game identification information, operator identification and contact information, etc.) generally found upon the paper format playing card 20 as the game is electronically processed and presented by the electronic means. This presentation could include a direct representation of the paper-based playing card 20 or presenting various gaming indicia of the playing card (e.g., playing symbols 52, gaming symbols 24, demarcation means 54, coverage means 32, etc.) without using the format/structure of paper-based playing card 20. Such a presentation could utilize a coverage means 32 have spaces allocated for gaming symbols 24, but would not display the gaming symbols 24 until after a participating player has engaged at that station of the electronic means 80 to play the supplemental game 30. The visual interface 84 could be readily adapted to act as a publication means 76 for the announcement and display of the winning gaming symbols 16 for a particular supplemental game 30.

As substantially shown in FIG. 5, the method or process 200 of playing a game with a gaming card could be initiated with step 202, selection of winning gaming symbol(s). The selection of winning game symbol(s) for a particular game can be done under the control of the operator who could first establish a set of gaming symbols for use in the invention 10. The system could then cause one or more of those symbols to be selected as one or more winning gaming symbols for that game/play of the game. Generally, the winning game symbols would be picked anew for each game, randomly, and therefore would substantially be different (not be repeated) from game to game. The operator can select the winning game symbol(s) by picking the numbers directly or employ a variety of random or pseudo-random symbol generating means. Once step 202 is substantially accomplished the process 200 could proceed to step 204, publication of the winning game symbol(s).

At step 204, publication of the winning game symbols, the operator could cause the public dissemination or publication of the selected winning gaming symbol(s). This could be accomplished by various publication means (e.g., signage, billboard, electronic message board, audible announcements, or other suitable communication means to transmit the selected winning gaming symbol[s] to the public.) This publication could at least occur at any time prior to the creating/providing and/or distribution of the playing cards/tickets as well as for any time after the creating/providing and/or distribution of the playing cards/tickets. In publishing the winning gaming symbol combination prior to game play of the invention, additional player excitement and anticipation, normally not available to such games could be added to the gaming to increase potential player awareness and participation in game play of invention as well as any primary games combined with the secondary game using method of the invention. At the completion of this step 204, the process 200 could proceed to step 206, creation of the playing card/ticket.

At step 206, creation of the playing card/ticket, the process 200 could begin when the ticket is processed by lottery ticket computer terminal for a participating player. This can be done with the invention game by itself or supplemental game in conjunction with a primary game. If done in conjunction with primary game, the gaming symbols of the supplemental game can be kept separate from the primary game or the playing symbols of the primary game can be demarcated for use as gaming symbols in the supplemental game.

In another version of the invention's supplemental-primary games embodiment, wherein the supplemental game is used again in conjunction with the primary game, the gaming ticket is not printed up at a lottery ticket computer terminal, rather the operator has it printed/created separately (for example, if primary game is Bingo, or a pull-tab lottery game, then the paper Bingo playing card could be first created at a printing house.) Generally, such non-terminal generated playing card creation requires a means of reversibly obscuring the gaming symbols for the supplemental (or at least for the playing symbols of the primary game if they will be demarcated for supplemental use in the invention's game.) In such instances, the selection of gaming symbols for these playing cards could occur at the printing house as well and can be done on a random basis or can be actively-selected at the direction of the operator.

In the electronic format versions of the invention, an electronic means could be employed to produce the game. This electronic means could create, at a connected, suitable user interface (e.g., a video terminal employing touch technology) used by a player, an image that could represent functional aspects of the playing card. In one or more such instances, the computer system at this step could assign gaming symbols for that image (e.g., separate gaming symbols or selected playing symbols of another game being played through the image used secondarily as gaming symbols). Spaces could be assigned and denoted for display of the assigned gaming symbols on the image, but the assigned gaming symbols would not be displayed through the image to the player at this time. The player at this step substantially could see the image of the visual representations of the functionalities of the playing card but could not observe any of the assigned gaming symbols for the represented playing card (e.g., blanked gaming symbol spaces.) At the substantial completion of this step 206, the method 200 could proceed to step 208, distribution/issuance of the playing card.

At step 208, issuance/distribution of the playing card, the invention after creating the playing card or creating the electronic image of the playing card/playing card gaming indicia could distribute it to the participating player/reveal the gaming symbols on the electronic image. In another embodiment (e.g., Bingo primary game card), the operator after setting up the gaming paraphernalia for the primary game, can distribute the playing cards to participating players. At the substantial completion of this step, the method could proceed to step 210, comparison of gaming symbols with the winning gaming symbols.

In those embodiments of the utilizing an electronic representation of the playing card, the computer system, after the player paid for playing the invention, could display to the player the assigned gaming symbols in their respective slots as shown on the visual image upon the user interface. At the substantial completion of this step 208, the method 200 could proceed to step 210, comparison of gaming symbols with the winning gaming symbols.

At step 210, comparison of gaming symbols with the winning gaming symbols, the participating player checks the gaming symbols of its respective playing card (e.g., the gaming symbols present via the visual image of the user interface) with the previously published winning gaming symbols for that game. In the embodiment utilizing the computer terminal created playing card, player merely checks the gaming symbols (or the playing symbols of the primary game demarcated as gaming symbols for the invention's game) with the published winning numbers. Depending on how the operator has set up the rules for winning, one or more matches of the playing card's gaming symbols with the selected winning gaming symbols could indicate a winning ticket. For example, the more matches that occur on a gaming card the greater in value of the prize that is one.

In the embodiment wherein the playing card is created at the printing house with reversibly covered or obscured gaming symbols for the invention's game, the participating player uncovers the obscured gaming symbols (e.g., pulls back the tab or opens a concealing flap). The player then checks the uncovered gaming symbols (or the uncovered playing symbols of the primary game demarcated as gaming symbols for the invention's game) with the published winning numbers.

After checking the gaming symbols of the playing card with published winning gaming symbols, if it is the embodiment is the one wherein the invention's game is played in conjunction with a second/primary game, the player can check the playing symbols of the ticket with the winning playing symbols of that game (e.g., selection of winning playing symbols that occurs after the playing ticket is distributed or the selection of fixed winning playing symbols that stay the same from game to game [e.g., pull tab game]).

If the player is successful in winning the game of the invention or the primary game, the player can use the playing ticket to claim the winning prize(s). After the substantial conclusion of this step, if the player wished to continue to play, the process 200 could return to step 202 selection of the gaming symbols for a new game or step 208 issuance of the playing card for playing again in the same game.

Conclusion

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As shown above, the invention can provide a playing card and method of operation for use as a game providing for a selection, from a set of gaming symbols, of winning game symbols prior to player participation in the game and generally done anew for each game. By taking advantage of early selection of winning gaming symbols, game publicity can occur in longer time periods (pre- and post-player participation) to promote more effectively player knowledge of, excitement in game that can ordinary lottery style games. The invention can further be played as a supplemental game to a primary game, both games utilizing the same playing card, wherein in one version, the playing symbols of the primary game can be demarcated for use as gaming symbols in the supplemental game. In such manner, the pre-play publication of selected winning gaming symbols of the supplemental game can be utilized to further enhance the gaming interest, the player excitement and the revenue stream capability of the primary game, as well as provide supplemental revenue streams for same with contained cost and relative ease.

What is claimed is:

1. A method of playing a game comprising the following steps:

(A) selecting one or more winning gaming symbols for the play of the game from a set of gaming symbols;

(B) providing at least one non-electronic playing card, the non-electronic playing card presenting both one or more gaming symbols for the play of the game and the one or more winning gaming symbols;

(C) publishing the one or more winning gaming symbols prior to a distribution of at least one non-electronic playing card;

(D) distributing at least one non-electronic playing card to at least one gaming participant; and (E) comparing by the at least one gaming participant of the gaming symbols of at least one distributed non-electronic playing card with the one or more winning gaming symbols to determine if the distributed non-electronic playing card has any gaming symbols that match the one or more winning gaming symbols to establish the distributed non-electronic playing card as a winning playing card.

2. The method of claim 1 wherein the selecting the winning gaming symbols occurs prior to the distributing of at least one non-electronic playing card to at least one gaming participant.

3. The method of claim 1 wherein the step of publishing one or more winning gaming symbols also occurs prior to the providing at least one non-electronic playing card.

4. The method of claim 1 wherein the providing the non-electronic playing card further comprises a step presenting gaming indicia of the non-electronic playing card upon a visual interface of an electronic means that is processing the play of the game.

5. The method of claim 1 further comprises the step of playing a primary game using a set of playing symbols, selecting one or more playing symbols of the primary game to be presented on the distributed non-electronic playing card, the play of the primary game being separate and distinct from the game, the game being a supplemental game to the primary game.

6. The method of claim 5 wherein the primary game could a game selected from a set of games consisting of Bingo, Keno, pull tab lottery, and quick pick lottery.

7. The method of claim 6 further comprises a step of demarcating one or more playing symbols of primary game as presented on the non-electronic playing card as being one or more gaming symbols as used in the game.

8. The method of claim 5 further comprises a step of selecting one or more winning gaming symbols of the primary game, the selecting one or more winning gaming symbols for the primary game occurs prior to the distributing at least one non-electronic playing card to at least one gaming participant.

9. The method of claim 5 further comprises a step of publishing one or more winning gaming symbols prior to the providing of at least one non-electronic playing card, the non-electronic playing card presenting one or more gaming symbols for use in the play of the game.

10. The method of claim 1 wherein the selecting of the winning gaming symbols occurs prior to the providing at least one non-electronic playing card.

11. The method of claim 1 wherein the providing the playing card further comprises a step of reversibly covering at least one of the one or more gaming symbols of the non-electronic playing card.

12. The method of claim 11 wherein the comparing the gaming symbols further comprises a step of uncovering the at least one of the one or more gaming symbols of the non-electronic playing card.

13. The method of claim 1 wherein the game is one game from a set of games consisting of Bingo, Keno, pull tab lottery, and quick pick lottery.

14. A method of playing a game that comprises the following steps:

(A) providing a set of gaming symbols;

(B) selecting from the set of gaming symbols, one or more winning gaming symbols for the play of the game;

(C) providing at least one playing card, the playing card presenting one or more gaming symbols for the play of the game;

(D) publishing one or more winning gaming symbols prior to a distribution of at least one playing card, the publishing includes displaying the winning gaming symbols upon the distributed playing card;

(E) distributing at least one playing card to at least one gaming participant; and (F) comparing by computer or processor or machine the gaming symbols of the distributed playing card with the selected one or more winning gaming symbols to determine if the distributed playing card has any gaming symbols that match the one or more winning gaming symbols to establish the distributed playing card as a winning game card;

wherein the publishing one or more winning gaming symbols prior to a distribution of at least one playing card is accomplished by another means other than the computer or processor or machine used for comparing the gaming symbols of the distributed playing card with the selected one or more winning gaming symbols.

15. The method of claim 14 wherein the selecting the winning gaming symbols occurs prior to the distributing of at least one playing card to at least one gaming participant.

16. The method of claim 14 further comprises a step of publishing one or more winning gaming symbols prior to the providing at least one playing card.

17. The method of claim 14 wherein the step of providing the playing card further comprises a step presenting gaming indicia of the playing card upon a visual interface of an electronic means that is processing the play of the game.

18. The method of claim 14 wherein the step of providing the playing card further comprises of a step of presenting at least the gaming indicia of the playing card from a visual interface of an electronic means that is processing the play of the game.

19. The method of claim 14 wherein the selecting from the set of gaming symbols occurs prior to the distribution of the at least one playing card.

* * * * *